US007387139B2

(12) United States Patent
Fitch

(10) Patent No.: US 7,387,139 B2
(45) Date of Patent: Jun. 17, 2008

(54) BIO-EJECTOR FILLING STOPS TO FACILITATE EFFICIENT FILLING

(75) Inventor: John S. Fitch, Los Altos, CA (US)

(73) Assignee: Palo Alto Research Center Incorporated, Palo Alto, CA (US)

( * ) Notice: Subject to any disclaimer, the term of this patent is extended or adjusted under 35 U.S.C. 154(b) by 476 days.

(21) Appl. No.: 11/017,438

(22) Filed: Dec. 20, 2004

(65) Prior Publication Data

US 2006/0130928 A1 Jun. 22, 2006

(51) Int. Cl.
*B65B 1/04* (2006.01)

(52) U.S. Cl. ..... 141/286; 141/65; 141/238; 422/100; 73/864.14

(58) Field of Classification Search ..... 141/59, 141/65, 67, 130, 235–242, 286; 422/99, 422/100; 73/863.32, 864.14, 863.84, 863.91
See application file for complete search history.

(56) References Cited

U.S. PATENT DOCUMENTS

| | | | | |
|---|---|---|---|---|
| 3,572,552 | A * | 3/1971 | Guinn | 222/263 |
| 4,537,231 | A * | 8/1985 | Hasskamp | 141/238 |
| 4,985,055 | A | 1/1991 | Thorne et al. | |
| 5,343,909 | A * | 9/1994 | Goodman | 141/242 |
| 6,779,657 | B2 | 8/2004 | Mainwaring et al. | |

* cited by examiner

*Primary Examiner*—Timothy L. Maust
(74) *Attorney, Agent, or Firm*—Fay Sharpe LLP

(57) ABSTRACT

Disclosed is a small volume, liquid dispenser having particular application in the analytical fields. The liquid dispensers can be quickly and reliably filled to a predetermined volume without monitoring liquid flows or volumes or filling times. Various versions of the dispenser and systems utilizing one or more of the dispensers are disclosed.

12 Claims, 2 Drawing Sheets

BIO-EJECTOR FILLING STOPS TO FACILITATE EFFICIENT FILLING

BACKGROUND

The present exemplary embodiment relates to liquid dispensers. It finds particular application in conjunction with small volume, analytical liquid dispensers, and will be described with particular reference thereto. However, it is to be appreciated that the present exemplary embodiment is also amenable to other like applications.

Three types of bio-ejection systems dominate the market today.

The first type consists of a large reservoir of liquid, connected to an ejection system via tubing. For example, in certain systems, one or more tubes are in communication with a very fine tube. Pressure pulses behind the liquid cause droplet ejection off the end of the small flow volume tube. In this system, the reservoir filling volume may not be critical, and once the tubing is charged or primed, there is little need for anything other than consistent ejection.

A second type of system is based upon contact printing. In this arrangement, an array of needles is dipped into a supply of liquid. A droplet of liquid wets each needle or pin as the array is withdrawn from the supply. The residual drop is then contacted to the substrate where the drop wicks onto the surface.

A third system aspirates and ejects. In this type of system, the liquid is drawn into the ejection system from a liquid supply. Once in the ejection mechanism, all or portions of the drawn volume may be ejected.

All of these systems are fixed systems and hardware intensive. Furthermore, the systems are relatively expensive.

Traditionally, filling single ejectors has been performed manually. In order to simplify the filling, it would be convenient to fill an ejector without monitoring quantity, time, or other parameters. If the filling stopped when the internal reservoirs filled to their maximum, without any close monitoring, that would render the filling system much easier to build and manage. Accordingly, a need exists for such a filling configuration.

BRIEF DESCRIPTION

In accordance with one aspect of the present exemplary embodiment, a liquid dispenser is provided which is adapted to allow filling with liquid to a predetermined volume, without intensive monitoring requirements. The dispenser comprises a lid defining an upper surface, an oppositely directed lower surface, and a fill aperture extending between the upper surface and the lower surface. The dispenser also comprises a base component defining a bottom face, and an oppositely directed inner face. The base component further defines a channel extending therethrough and provides fluid communication between the inner face and the bottom face. The dispenser further comprises a liquid reservoir disposed between the lid and the base. The reservoir defines a hollow region and a passage providing communication to the hollow region wherein the passage is in fluid communication with the channel of the base component. The dispenser further comprises a liquid stop device disposed between the fill aperture of the lid and the hollow region of the liquid reservoir.

In accordance with another aspect of the present exemplary embodiment, a liquid dispenser adapted to readily accommodate filling to a selected predetermined volume is provided. The dispenser comprises a lid defining a first fill aperture and a second fill aperture. The dispenser also comprises a base including an apertured region, a liquid port, and a channel providing flow communication between the apetured region and the liquid port. The dispenser further comprises a liquid reservoir disposed between the lid and the base and defining a first interior hollow region and a second hollow interior region. Both the first and second regions are accessible from a passageway defined in a wall of the reservoir. The dispenser also comprises a first liquid stop device disposed between the first fill aperture and the first interior hollow region defined in the liquid reservoir. The dispenser further comprises a second liquid stop device disposed between the second fill aperture and the second interior hollow region defined in the liquid reservoir.

In accordance with yet another aspect of the present exemplary embodiment, a system is provided for readily filling at least two liquid dispensers. The system comprises a distribution header providing access to a vacuum source or pressure differential. The header includes at least two access members. The system also comprises at least two liquid dispensers in which each dispenser is adapted to be placed in communication with a corresponding access member and thereby in communication to the vacuum source. Each dispenser includes (i) a lid defining a fill aperture for communication with the vacuum source, (ii) an apertured base, (iii) a liquid reservoir disposed between the lid and the base, and (iv) a liquid stop device disposed in the flow path between a corresponding access member and the liquid reservoir.

DETAILED DESCRIPTION

Figure 1:
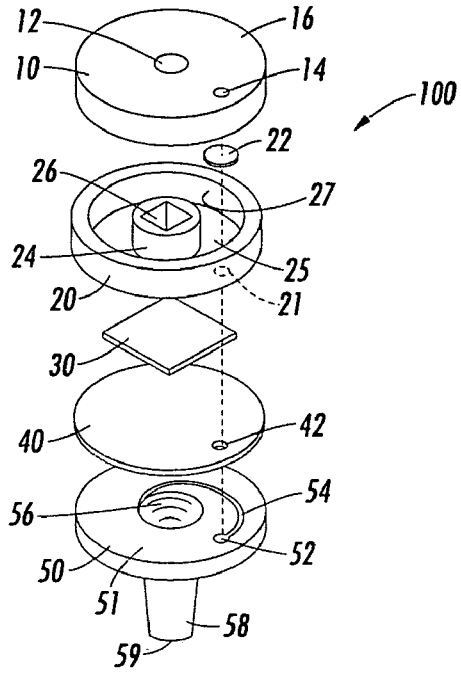
FIG. 1 is an exploded perspective view of an exemplary embodiment dispenser.

FIG. 1 illustrates an exemplary embodiment bio-ejector liquid dispenser 100. The dispenser 100 comprises a cap 10, a reservoir 20, an optional piezo electric element 30 and substrate 40, and a base component 50. The reservoir 20, piezo element 30, and substrate 40 are disposed between the cap 10 and the base component 50. The cap 10 defines a centrally located aperture 12 along an outermost upper face 16 and a secondary aperture 14 defined along the perimeter of the cap 10. The cap 10 further defines a lower surface (not shown) oppositely directed from the upper face 16. The apertures 14 and 12 extend between the upper face 16 and the lower face. The reservoir 20 is generally cylindrical and defines an interior hollow region extending between an outerwall 27, an upwardly extending post 24, and a floor 25 extending between the wall 27 and the post 24. An aperture 21 is defined along the floor 25 of the reservoir 20. The post 24 defines an aperture 26 or a receiving region generally extending across the height of the post 24. Disposed between the aperture 14 defined in the cap 10 and the reservoir 20, is a liquid stop component 22, described in greater detail below. The piezo component 30 is situated between the reservoir 20 and the substrate 40. As explained in greater detail herein, the piezo component 30 is affixed or otherwise retained on the substrate 40. The piezo component 30 and the substrate 40 are optional and described below. The substrate 40 and the cap 10 are generally shaped to match or at least accommodate the cross-sectional shape of the reservoir 20. For cylindrically shaped reservoirs 20, the cap 10 and substrate 40 are circular shaped. The substrate 40 also defines an aperture 42 defined along its perimeter. Aperture 42 is described in greater detail herein. The base component 50 defines an inner face 51, an oppositely directed bottom face (not shown), a recessed liquid receiving port 52, an outwardly extending tip 58 with an aperture or ejection hole 59 accessible at the distal end of the tip 58, a fluidway 56 extending within the tip 58, and a channel 54 extending between the port 52 and the fluidway 56. It will be appreciated that the base component 50 does not require the outwardly projecting tip 58. In an alternate version, the base component 50 could be devoid of such a tip 58. The fluidway 56 could extend between the inner face 51 and an oppositely directed outer face (not shown).

The piezo component 30 and its substrate 40 can optionally be used or incorporated in the dispenser to provide an electrical signal upon application of a predetermined stress to the substrate. Such stress may indicate filling of the dispenser or engagement with a holder, for example with the aperture 26 in reservoir 20 in FIG. 1.

Referring further to FIG. 1, the reservoir 20 is filled by drawing liquid up through the tip 58. A vacuum source or source for inducing a pressure differential relative to the liquid source, is placed in communication with the aperture 14. Evacuating air exits from the dispenser through the liquid stop device 22 and out of the cap 10. Once the liquid level in the reservoir 20 contacts the liquid stop device 22, filling ceases. When the liquid front hits the stop device 22, the vacuum continues to pull on the liquid, degassing it to some degree. The dispenser is then full, and ready for use. A pressure or vacuum may be applied to the fluid in the dispenser, through the stop device, during ejection.

The exemplary embodiment dispenser is configured such that it has a face, such as cap 10 in FIG. 1 which connects to a holder and vacuum source. That is, the dispenser can be configured to engage with and be affixed to, a holder that extends through the aperture 12 in the cap 10 and which is received in the aperture 26 of the reservoir 20. The exemplary embodiment dispenser however is not limited to this particular configuration and includes other configurations for engagement with a holder. More specifically, aperture 12 serves to allow a pogo pin electrical connection to the piezo element. However, it will be understood that the aperture can serve many different functions depending upon the particular application.

The opposite end of the exemplary embodiment dispenser 100 includes an aperture, such as tip 58 in FIG. 1, which may be dipped, immersed, or otherwise placed in communication with a liquid supply. The apertured tip 58 is immersed or at least contacted with the liquid supply. Upon application of a vacuum or pressure differential such as at aperture 14, liquid is displaced into the tip 58 and into the internal volume of the dispenser.

The internal volume of the exemplary embodiment dispenser is designed such that is has minimal unswept volumes. A liquid front coming in from the liquid supply, such as from the distal end of the tip 58, sweeps all of the air out as the liquid front progresses toward the vacuum source. Referring to FIG. 1, the dispenser 100 includes a smooth fluidway 56 which transitions into an arcuate channel 54. The channel 54 provides fluid communication between the fluidway 56 and the port 52. The dispenser 100 and its components are assembled such that the port 52 is positioned adjacent or proximate to the aperture 42 in the substrate 40. The aperture 42 is aligned with the aperture 21 of the reservoir 20. The liquid stop device 22 is positioned between the reservoir 20 and the aperture 14 in the cap 10.

The air in the dispenser exits through the stop device such as device 22 in FIG. 1. The stop device is generally incorporated as part of the dispenser manufacturing process. However, the exemplary embodiment includes configurations in which the stop device is incorporated into a dispenser after assembly of the dispenser.

Figure 2:
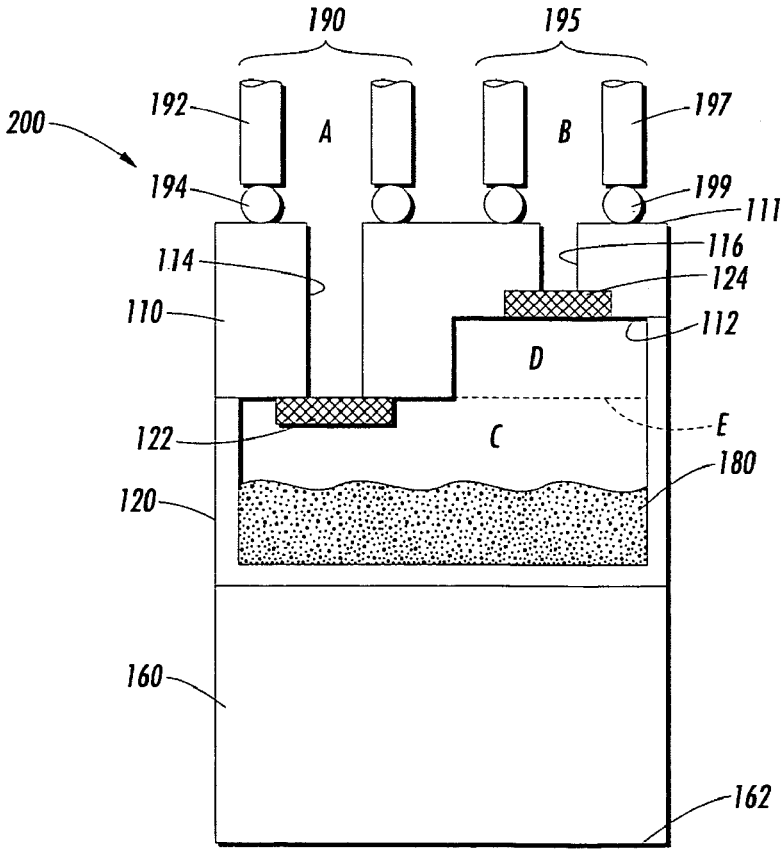
FIG. 2 is a schematic side view of another exemplary embodiment dispenser.

FIG. 2 schematically illustrates another exemplary embodiment dispenser 200 adapted for selective volume filling. The dispenser 200 comprises a cap 110, a base 160, and a reservoir 120 providing an interior hollow, liquid-holding region denoted as sub regions C and D. The dispenser 200 enables filling to a volume corresponding to region C, or to a volume corresponding to the sum of the volumes of regions C and D. The lid 110 defines a first aperture 114 and a second aperture 116 both extending through the thickness of the lid 110. The lid defines an outer face 111 and an oppositely directed inner face 112. The lid also defines a recessed region along the face 112 that in turn defines the region D. Disposed in flow communication with apertures 114 and 116 in the lid 110 are liquid stop devices 122 and 124, respectively. As will be appreciated, the liquid stop devices 122 and 124 can be disposed along the face 112 of the lid 110 such that they are flush with that face, as with device 124, or project outward from that face, as with device 122. The reservoir 120 defines an internal volume for receiving and storing a liquid 180. The base 160 defines at least one fluid passageway (not shown) which provides for fluid communication between the internal volume of the reservoir, i.e. regions C and D, and a bottom face 162 of the base 160.

The dispenser 200 is filled by contacting the surface 162 of the base 160 with a liquid, or immersing, either wholly or partially, the dispenser 200 or more specifically the base 160, in liquid. A first vacuum source 190 is applied over the aperture 114. The vacuum source 190 can be in the form of a tube 192 having a sealing component 194 on its distal end through which vacuum A is applied. A second vacuum source 195 is provided in the form of tube 197 having sealing component 199 through which vacuum B is applied. In the event it is desired to fill the dispenser 200 to volume C, or rather to a particular level such as level E, vacuum A is applied to the aperture 114 thereby drawing liquid 180 into the region C of the reservoir 120. Upon the level of liquid 180 entirely contacting or covering the liquid stop member 122, filling of the dispenser ceases. In the event it is desired to fill the reservoir to a greater volume, such as by an increase corresponding to the volume of region D, vacuum B is applied to the aperture 116 thereby drawing liquid 180 into the region D of the reservoir 120. Upon the level of liquid 180 entirely contacting or covering the liquid stop member 124, filling of the dispenser 200 ceases.

All of the components of the exemplary embodiment dispensers can be formed from nearly any suitable material. Representative examples for forming the cap, reservoir, substrate, and tip component include plastic and metal. Plastic is generally preferred due to its low cost and ability to be molded. The optional piezo component is formed from materials known in the art. The substrate on which is disposed or affixed the piezo component, is preferably formed from stainless steel or other suitable metal.

The liquid stop device, such as item 22 in FIG. 1 or items 122 and 124 in FIG. 2, is preferably formed from a thin layer of a gas permeable material such as Gore-Tex®, available from W. C. Gore & Associates. The Gore-Tex® membrane is a composite of two unique materials having mechanical and chemical stability.

One of the two components in Gore-Tex® is pure expanded polytetrafluoroethylene PTFE which is a hydrophobic or water-hating material. Integrated in the PTFE structure is an oleophobic, or oil-hating substance which allows moisture vapor to pass through, but is a physical barrier that prevents the penetration of contaminating substances such as oils, cosmetics etc. which could affect the waterproof performance. Representative grades of Gore-Tex which are particularly suitable for the exemplary embodiment dispensers include, but are not limited to Gore-Tex Membrane. The exemplary embodiment dispenser includes the use of other materials for the liquid stop device besides Gore-Tex®. Representative examples of alternate materials besides Gore-Tex which are suitable for the exemplary embodiment dispensers include, but are not limited to porous nylon, porous polymers, or mesh fabrics which are treated such that their surface tension is low and causes the liquid to be repelled rather than absorbed.

In certain alternate embodiments or variations, it is contemplated to avoid the use a separate liquid stop device, such as device 22 in FIG. 1, and instead utilize a relatively small aperture defined in the cap or in a substrate incorporated in the dispenser so as to replace the device 22. The aperture is sized so as to prevent or preclude the passage of liquid, yet allow gas to flow therethrough. Although the diameter of such a small aperture will vary depending upon the liquid and solid combination, and the degree of pressure differential between the liquid and vacuum, it is contemplated that the aperture will have a diameter of from about 10 to about 30 micron, more preferably from about 0.1 micron to about 3 micron, and most preferably from about 0.1 micron to about 1 micron. The use of multiple apertures is also contemplated, and may be required to provide sufficient evacuated air flow.

The exemplary embodiment dispensers are different from currently known devices in that they can be in the form of a single dispenser, which contains all of its liquid. The dispenser is filled prior to many ejection runs. A plurality of dispensers could be used in parallel to create complex arrays of liquids. Once the ejection is done, the dispenser could be stored, refilled, cleaned, or disposed of. The dispenser is designed to be inexpensive. Liquid stop 22 could be replaced for reuse should it become damaged.

Figure 3:
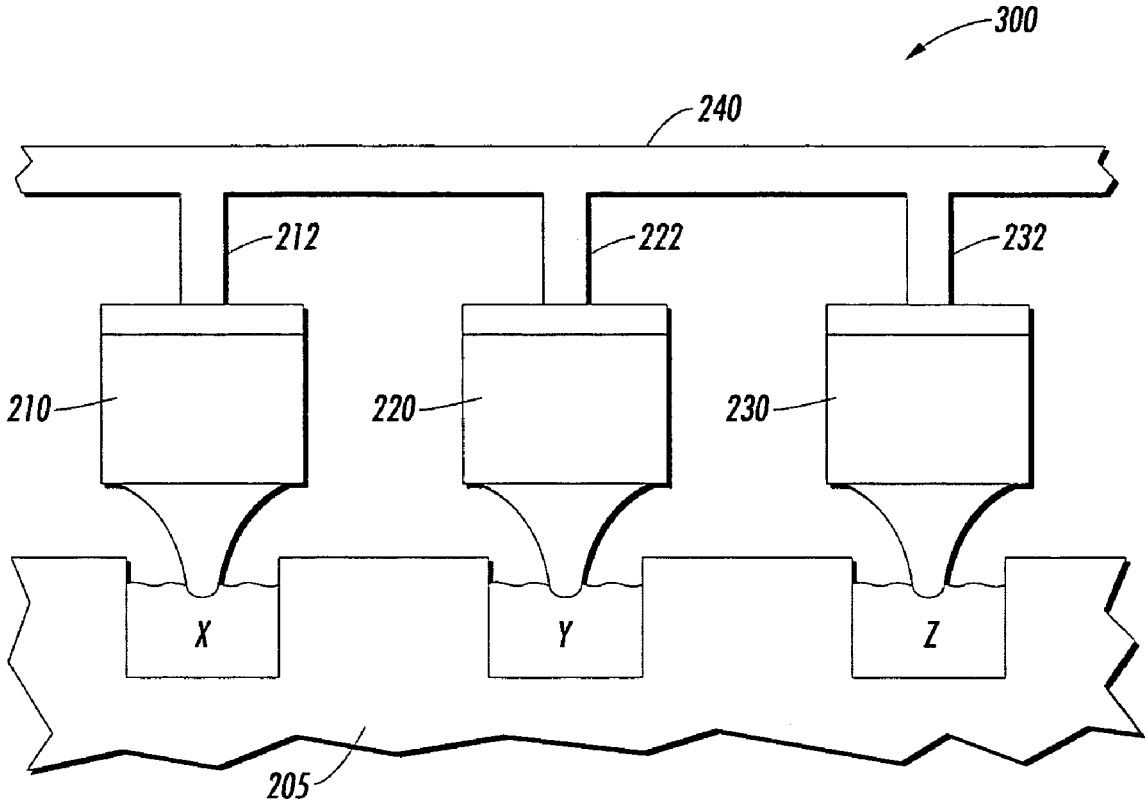
FIG. 3 is a schematic of an exemplary embodiment system including multiple dispensers that can be simultaneously filled.

FIG. 3 schematically illustrates an exemplary embodiment system 300 for simultaneously filing a plurality of dispensers 210, 220, and 230. A distribution header providing access to a vacuum source 240 is utilized having a corresponding number of stand-offs or access members, such as members 212, 222, and 232. A multi-well liquid retainer 205 defining a plurality of wells containing liquids X, Y, and Z is provided. The system 300 having dispensers 210, 220, and 230 is placed in fluid communication with corresponding wells of the retainer 205. A source of vacuum 240 is applied to each of the dispensers, each dispenser being in fluid communication with a respective well, to thereby draw a predetermined amount of the liquid in a particular well into the corresponding dispenser. For example, upon application of the vacuum from source 240, liquid X is drawn into dispenser 210, liquid Y is drawn into dispenser 220, and liquid Z is drawn into dispenser 230. Filling of the dispensers can occur concurrently and until a predetermined reservoir volume in each dispenser is filled.

Instead of utilizing one or more liquid stop devices as described herein, or very fine apertures that allow passage of air but preclude that of liquid, the exemplary embodiment dispensers could utilize other equivalent components to restrict or block the flow of liquid. Examples include, but are not limited to one or more necked down channels, channels with flow restrictions, or channels with appropriate nonwetting properties. Moving check valve mechanisms could be utilized. Ball float valves, or flap valves, for example may be used. A floating ball in the reservoir, which seals against a vacuum hole once liquid floats it into position, could be employed. These mechanisms would be desirable for ejectors other than biofluid ejectors.

There exist numerous advantages with regard to the exemplary embodiment dispensers described herein. The exemplary embodiment dispenser simplifies the filling steps. The dispenser needs only to be filled simply and robustly in order to succeed. The dispenser is easy to incorporate in existing systems, and inexpensive. The dispenser, with liquid stop, allows pressure regulation of the volume inside the ejector during operation, without allowing liquid to be inadvertently drawn into the regulation system.

Although the exemplary embodiment ejectors and ejector systems described herein utilize a piezo ejection method, the exemplary embodiment includes other types and configurations such as, but not limited to, a thermal ink jet type of ejector, an acoustic ejector, a pulsed capillary tube ejector, and a pulsed solenoid style ejector.

Although the exemplary embodiment dispenser has been described in terms of being assembled from multiple components, the dispenser can be formed as a unitary one-piece item. In addition, one or more features of any of the dispensers described herein can be interchanged or used in conjunction with one or more features of any other dispenser or system described herein.

While particular embodiments have been described, alternatives, modifications, variations, improvements, and substantial equivalents that are or may be presently unforeseen may arise to applicants or others skilled in the art. Accordingly, the appended claims as filed and as they may be amended are intended to embrace all such alternatives, modifications, variations, improvements, and substantial equivalents.

The invention claimed is:

1. A liquid dispenser adapted to allow filling with liquid to a predetermined volume, the dispenser comprising:

a lid defining an upper surface, an oppositely directed lower surface, and a fill aperture extending between the upper surface and the lower surface;

a base component defining a bottom face, an oppositely directed inner face, the base component defining a channel extending therethrough and providing fluid communication between the inner face and the bottom face;

a liquid reservoir disposed between the lid and the base, the reservoir defining a hollow region and a passage providing communication to the hollow region wherein the passage is in flow communication with the channel of the base component; and a liquid stop device, comprised of a thin layer of a gas permeable material, disposed between the fill aperture of the lid and the hollow region of the liquid reservoir.

2. The liquid dispenser of claim 1 wherein the material is selected from the group consisting of (i) porous nylon, (ii) porous polymers, and (iii) mesh fabrics, wherein (i), (ii), and (iii) are treated such that their surface tension is sufficiently low so that the liquid is repelled rather than absorbed.

3. The liquid dispenser of claim 1 wherein the material is a composite material comprising (i) a hydrophobic material and (ii) an oleophobic material.

4. The liquid dispenser of claim 3 wherein the hydrophobic material is polytetrafluoroethylene.

5. The liquid dispenser of claim 1 further comprising:

a substrate and piezo-electric element disposed adjacent to the liquid reservoir.

6. The liquid dispenser of claim 1 wherein the base component defines a tip projecting outward from the bottom face, and the tip defines the channel extending therethrough.

7. A liquid dispenser adapted to allow filling with liquid to a predetermined volume, the dispenser comprising:

a lid defining an upper surface, an oppositely directed lower surface, and a fill aperture extending between the upper surface and the lower surface;

a base component defining a bottom face, an oppositely directed inner face, the base component defining a channel extending therethrough and providing fluid communication between the inner face and the bottom face;

a liquid reservoir disposed between the lid and the base, the reservoir defining a hollow region and a passage providing communication to the hollow region wherein the passage is in flow communication with the channel of the base component;

a substrate and piezo-electric element disposed adjacent to the liquid reservoir; and a liquid stop device disposed between the fill aperture of the lid and the hollow region of the liquid reservoir.

8. The liquid dispenser of claim 7 wherein the liquid stop device is a thin layer of a gas permeable material.

9. The liquid dispenser of claim 8 wherein the material is selected from the group consisting of (i) porous nylon, (ii) porous polymers, and (iii) mesh fabrics, wherein (i), (ii), and (iii) are treated such that their surface tension is sufficiently low so that the liquid is repelled rather than absorbed.

10. The liquid dispenser of claim 8 wherein the material is a composite material comprising (i) a hydrophobic material and (ii) an oleophobic material.

11. The liquid dispenser of claim 10 wherein the hydrophobic material is polytetrafluoroethylene.

12. The liquid dispenser of claim 7 wherein the base component defines a tip projecting outward from the bottom face, and the tip defines the channel extending therethrough.

* * * * *